US010704200B2

(12) United States Patent
Pang et al.

(10) Patent No.: US 10,704,200 B2
(45) **Date of Patent: *Jul. 7, 2020**

(54) OIL AND GREASE RESISTANT PAPERBOARD

(71) Applicant: WestRock MWV, LLC, Norcross, GA (US)

(72) Inventors: Jiebin Pang, Glen Allen, VA (US); Scott J. Reigel, Columbus, GA (US); Natasha G. Melton, Richmond, VA (US); Terry Clark, Columbus, OH (US); Teresa Krug, Henrico, VA (US); Steven Parker, Raleigh, NC (US)

(73) Assignee: WestRock MWV, LLC, Atlanta, GA (US)

( * ) Notice: Subject to any disclaimer, the term of this patent is extended or adjusted under 35 U.S.C. 154(b) by 96 days.

This patent is subject to a terminal disclaimer.

(21) Appl. No.: 15/814,548

(22) Filed: Nov. 16, 2017

(65) Prior Publication Data

US 2018/0135252 A1 May 17, 2018

Related U.S. Application Data

(60) Provisional application No. 62/423,217, filed on Nov. 17, 2016.

(51) Int. Cl.

| | |
|---|---|
| ***D21H 21/14*** | (2006.01) |
| ***D21H 21/16*** | (2006.01) |
| ***D21H 19/36*** | (2006.01) |
| ***D21H 19/38*** | (2006.01) |
| ***D21H 19/58*** | (2006.01) |
| ***D21H 19/64*** | (2006.01) |
| ***D21H 19/82*** | (2006.01) |
| ***D21H 27/10*** | (2006.01) |

(52) U.S. Cl.

CPC ..... *D21H 21/14* (2013.01); *D21H 19/36* (2013.01); *D21H 19/385* (2013.01); *D21H 19/58* (2013.01); *D21H 19/64* (2013.01); *D21H 19/822* (2013.01); *D21H 21/16* (2013.01); *D21H 27/10* (2013.01)

(58) Field of Classification Search

CPC ..... D21H 21/14; D21H 21/28; D21H 19/00; D21H 19/36; D21H 19/38; D21H 19/385; D21H 19/40; D21H 19/44; D21H 19/50; D21H 15/56; D21H 19/80; D21H 19/82; D21H 19/822

USPC ..... 428/341

See application file for complete search history.

(56) References Cited

U.S. PATENT DOCUMENTS 5,981,011 A * 11/1999 Overcash ..... D21H 19/16 428/34.2
6,193,831 B1 * 2/2001 Overcash ..... D21H 19/16 156/230

(Continued)

FOREIGN PATENT DOCUMENTS

WO WO 96/05054 A1 2/1996
WO WO2016130751 A1 8/2016

*Primary Examiner* — Jane L Stanley

(74) *Attorney, Agent, or Firm* — WestRock Intellectual Property Group

(57) ABSTRACT

A coated paperboard is disclosed which includes a barrier coating containing substantially no fluorochemical or wax, exhibiting good resistance to oil, grease, and moisture and having no tendency toward blocking.

15 Claims, 6 Drawing Sheets

(56) References Cited

U.S. PATENT DOCUMENTS

| | | | | |
|---|---|---|---|---|
| 6,645,616 | B1 * | 11/2003 | Sammarco | B32B 27/10 229/5.81 |
| 6,740,373 | B1 * | 5/2004 | Swoboda | B32B 29/06 229/5.81 |
| 7,348,067 | B1 * | 3/2008 | Hoffman | B32B 29/00 156/182 |
| 9,181,658 | B2 * | 11/2015 | Bushhouse | C09C 1/0081 |
| 2004/0121080 | A1 * | 6/2004 | Urscheler | B05D 1/305 427/420 |
| 2006/0099410 | A1 * | 5/2006 | Miller | C09D 129/04 428/341 |
| 2007/0087212 | A1 * | 4/2007 | Iyengar | B32B 7/06 428/474.4 |
| 2007/0232743 | A1 * | 10/2007 | Laviolette | D21H 19/40 524/445 |
| 2011/0262745 | A1 * | 10/2011 | Ronka | D21H 19/24 428/349 |
| 2015/0111054 | A1 * | 4/2015 | Salminen | D21H 23/48 428/537.5 |
| 2016/0230343 | A1 | 8/2016 | Pang et al. | |
| 2017/0030021 | A1 * | 2/2017 | Hellsten | D21H 19/54 |
| 2018/0142418 | A1 * | 5/2018 | Sundholm | D21H 25/04 |

* cited by examiner

OIL AND GREASE RESISTANT PAPERBOARD

REFERENCE TO RELATED APPLICATION

This application claims the benefit of priority under 35 U.S.C. § 119(e) of U.S. provisional application Ser. No. 62/423,217 filed on Nov. 17, 2016, which is hereby incorporated by reference in its entirety.

BACKGROUND OF THE INVENTION

Field of Invention

This disclosure relates to paperboard substrates having oil and grease resistance while remaining highly repulpable and without having a tendency toward blocking.

Description of the Related Art

Sustainable packages using renewable, recyclable, and/or compostable materials are increasingly and strongly desired for food service and food packaging. Paper or paperboard itself is one of the most sustainable materials for packaging applications; however, paper or paperboard is often coated or laminated with barrier materials to fulfill the requirements of packaging. These additional barrier coatings or films often make the finished packages no longer repulpable or compostable. For example, widely used polyethylene coated paperboard is neither compostable nor recyclable under typical conditions. Polylactide coated paperboard can be compostable under industrial conditions, but it is not recyclable.

Oil and grease resistance is one of the top needs for paperboard packages in food and food service industries. Several technologies including specialty chemical (wax, fluorochemicals, starch, polyvinyl alcohol (PVOH), sodium alginate, etc.) treatment, polymer extrusion coating (polyethylene, etc.) have been employed to provide oil and grease resistance of paperboard packaging. However, the paper or paperboard treated with wax or coated with polyethylene, which is currently used in oil and grease resistant packaging, has difficulties in repulping. Paper or paperboard treated with specialty chemicals such as fluorochemicals has potential health, safety and environmental concerns, and scientists have called for a stop to non-essential use of fluorochemicals in common consumer products including packaging materials.

There is a need for oil and grease resistant paperboard without environmental or safety concerns. Aqueous coating is one of the promising solutions to achieve these goals, particularly if the coated paperboard is highly repulpable.

SUMMARY OF THE INVENTION

The general purpose of the invention is to provide an oil and grease barrier on paperboard by applying two layers of aqueous coating without fluorochemicals or wax. The coatings can either be applied on a paper machine or by an off-line coater. Paperboard coated according to the invention provides resistance to oil, grease and moisture, does not have any tendency to block, is compliant to safety and environmental regulations, has good repulpability, and can be produced at a low cost.

In one embodiment a coated paperboard is disclosed which includes a paperboard substrate having a first side and a second side; a first coating in contact with the first side, the first coating having a coat weight from 5 to 12 lbs per 3000 $ft^2$ and comprising binder and pigment, the first coating containing substantially no fluorochemical or wax; a second coating applied over the first coating, the second coating also containing substantially no fluorochemical or wax, wherein the coated paperboard provides barrier properties to at least one of oil, grease, and moisture; and wherein the coated paperboard is at least 98.5% repulpable.

DETAILED DESCRIPTION OF THE INVENTION

Figure 1:
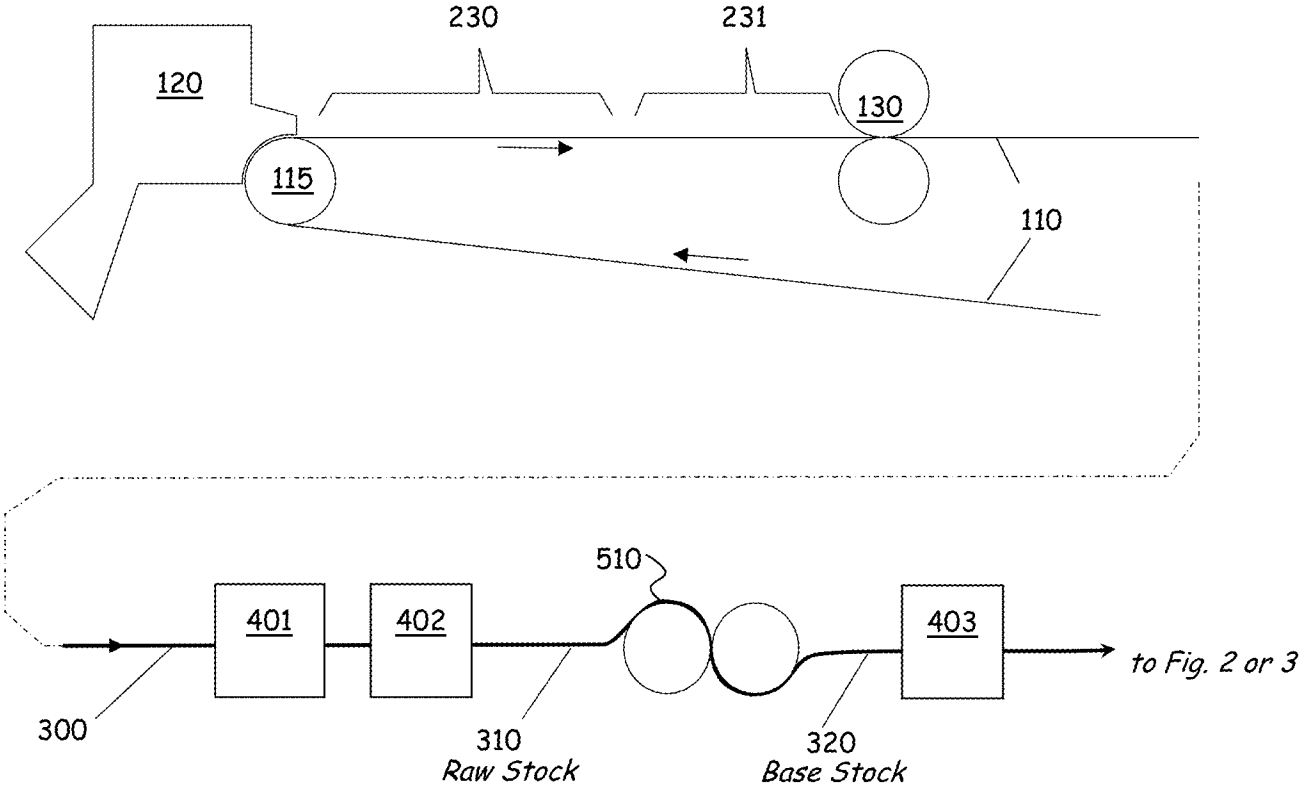
FIG. 1 illustrates a method for producing a base stock on a paperboard machine.
Figure 2:
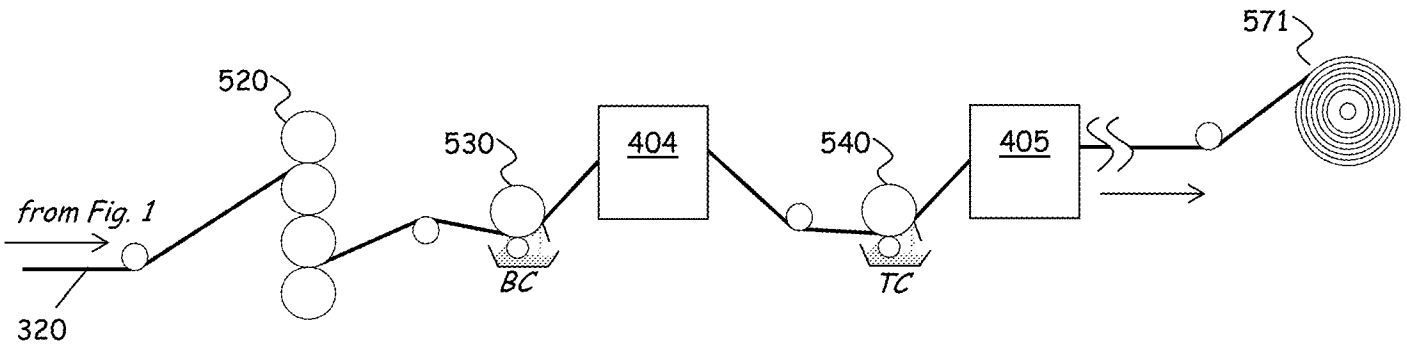
FIG. 2 illustrates a method for treating the base stock from FIG. 1 by applying coatings to one side on a paperboard machine.

FIG. 1 and FIG. 2 illustrate an exemplary on-paper machine method for coating one side of a paperboard web with two layers of aqueous coating. A forming wire 110 in the form of an endless belt passes over a breast roll 115 that rotates proximate to a headbox 120. The headbox provides a fiber slurry in water with a fairly low consistency (for example, about 0.5% solids) that passes onto the moving forming wire 110. During a first distance 230 water drains from the slurry and through the forming wire 110, forming a web 300 of wet fibers. The slurry during distance 130 may yet have a wet appearance as there is free water on its surface. At some point as drainage continues the free water may disappear from the surface, and over distance 231, water may continue to drain although the surface appears free from water.

Eventually the web is carried by a transfer felt or press felt through one or more pressing devices such as press rolls 130 that help to further dewatering the web, usually with the application of pressure, vacuum, and sometimes heat. After pressing, the still relatively wet web 300 is dried, for example using dryer or drying sections 401, 402 to produce a dry web ("raw stock") 310 which may then be run through a size press 510 that applies a surface sizing to produce a sized "base stock" 320 which may then be run through additional dryer sections 403 and (on FIG. 2) smoothing steps such as calendar 520.

The base stock 320 may then be run through one or more coaters. For example, coater 530 may apply a first coat ("BC") to a first side ("C1") of the web, and the first coat may be dried in one or more dryer sections 404. Coater 540 may apply a second coat ("TC") to the first side of the web, and the second coat may be dried in one or more dryer sections 405.

Figure 3:
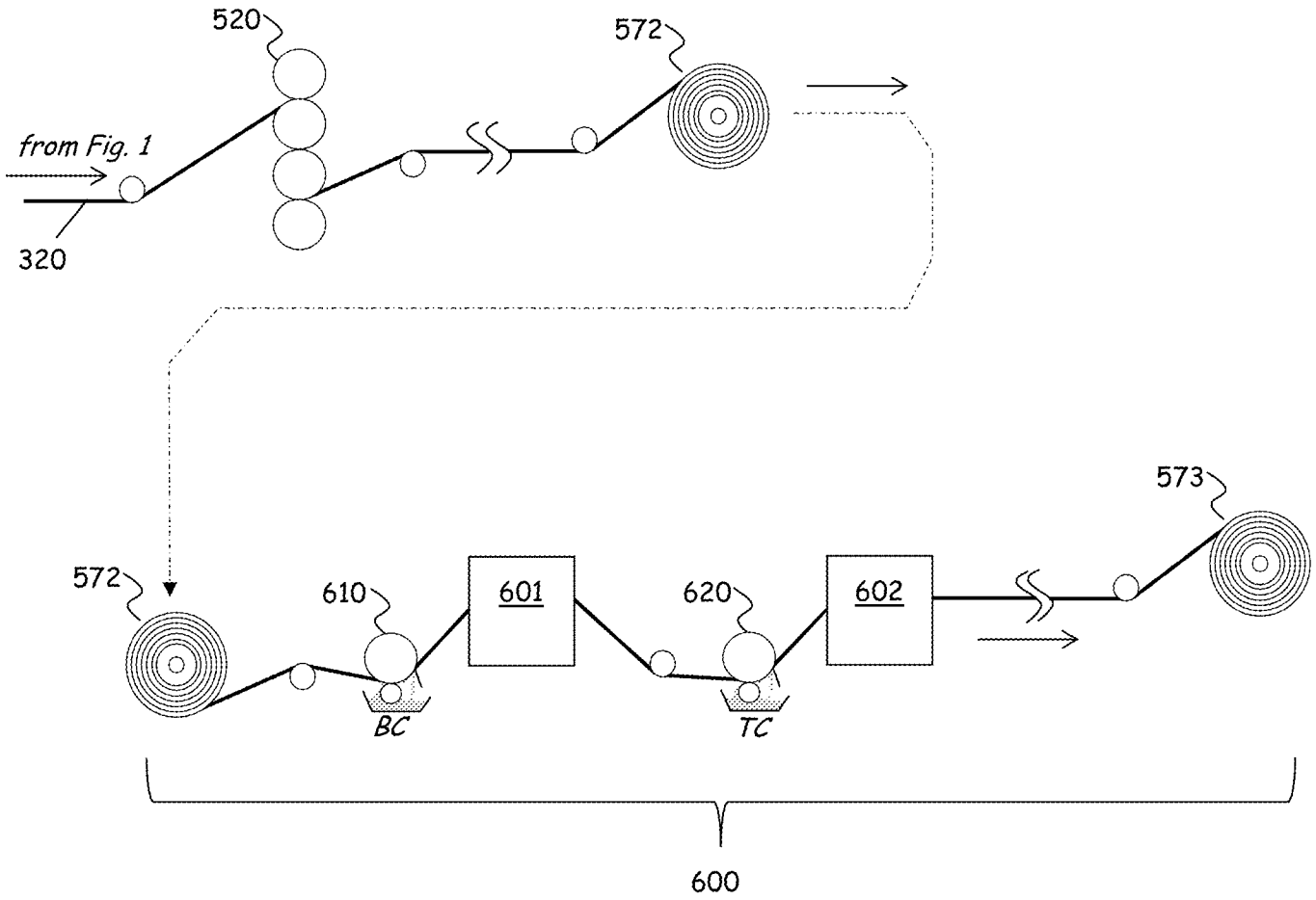
FIG. 3 illustrates a method for treating the base stock from FIG. 1 by applying coatings to one side on an off-machine coater.

Instead of applying coating by on-machine coaters as shown in FIG. 2, coating may be applied by an off-machine coater as shown in FIG. 3. In such cases, the paperboard having been produced on the paper machine and wound onto reel 572 may then be transported (as a reel or as smaller rolls) to an off machine coater 600, where the paperboard is unwound from reel 572, given a first coating by coater 610, dried in dryer(s) 601, given an optional second coating by coater 620, dried in dryer(s) 602, optionally given further treatment (such as gloss calendaring) and then wound onto reel 573. An off machine coater could instead apply a single coat to one side of the paperboard, or could apply a single coat to each side, or could apply more than one coat to either or both sides. Alternately some coating may be done on the paper machine, with additional coating done on an off-machine coater.

Various types of coating devices may be used. The coaters illustrated in FIGS. 2-3 are devices where a coating is held in a pan, transferred by a roll to the lower surface of the web (which may be either the first side or the second side depending on the web path), and then the excess coating scraped off by a blade as the web wraps partially around a backing roll. However other coater types may be used instead, including but not limited to curtain coater, air knife coater, rod coater, film coater, short-dwell coater, spray coater, and metering film size press.

Following the coaters, there may be additional equipment for further processing such as additional smoothening, for example gloss calendaring. Finally, the web is tightly wound onto a reel 570.

The general process of papermaking and coating having been outlined at a high level in the preceding description and with FIGS. 1-3, we now turn to the coatings of the present invention. Typical aqueous barrier coatings often use specialty polymer(s), wax, and/or a higher polymer binder level (compared to conventional print coatings). These coatings can cause problems with repulpability of the coated paperboard because the coatings are usually difficult to breakdown to acceptable size or tend to form 'stickies' in paperboard making with the recycled fibers.

Furthermore, many barrier coatings give paperboard a tendency to 'block' (the layers stick together) either in the reel 570, 571, 572, 573 or after it is rewound into rolls. Particularly in the reel 570, there may be residual heat from the dryers, which may dissipate quite slowly because of the large mass of the reel. Higher temperatures may increase the tendency toward blocking.

It is known that paperboard coated with conventional printability coatings usually does not block, and usually is fully repulpable. It would be advantageous if non-blocking and fully repulpable coatings also provided at least some degree of barrier properties. However, conventional printability coatings do not provide satisfactory barrier properties. Their formulations have relatively low levels of binder so as to absorb rather than repel fluid (printing ink, for example).

Binder amounts in conventional printability coatings can range from 15-25 parts per 100 parts of pigment by weight for base coatings, and 10-20 parts per 100 parts pigment by weight for top coatings. Printing grades would tend to be in the lower half of these ranges. Limiting the binder amount in the top coating may allow printing inks or adhesives to absorb readily into the printability coating. Simply increasing the binder to improve barrier properties eventually interferes with printability and causes additional problems, including blocking and repulpability problems.

Similar blocking and repulpability problems exist with many aqueous barrier coatings that use specialty polymer(s) and/or a higher polymer binder level (compared to printability coatings), with the deleterious effect that the coated paperboard is not completely recyclable and tends to block at elevated temperature or pressure.

In contrast, the inventive coatings disclosed in the present application provide easy repulping, do not block at elevated temperature and pressure, and show good barrier properties, while using conventional pigments that are low-cost and readily available as coating materials for the paper or paperboard industry.

Conventional pigments are used in the present invention and may include, but are not limited to, kaolin clay, calcium carbonate, etc. Pigments used in the examples herein are given the following 'shorthand' designations:

"Clay-A" #2 clay, regular brightness, particle size 80-94%<2 microns

"Clay-B" #1 clay, high brightness, particle size 90-100%<2 microns

"TiO2" rutile titanium dioxide, median particle size 0.3-0.4 microns

For a binder in the coatings here, SBR latex and protein were used. The choice of binder in the examples is not meant to be limiting in any way.

Coatings including control coatings in the present invention were prepared according to the formulations shown in Table 1, which provides a list of major constituents in dry parts of the aqueous coating formulations used to achieve the oil and grease resistance without blocking or repulpability problems. The base coat was always the same, while the top coat formula was varied. Substantially no fluorochemical was used in the coatings. By "substantially no fluorochemical" is meant that fluorochemicals were not deliberately utilized, and that any amount present would have been at most trace amounts. Although fluorochemicals can be excluded in lab experiments, trace amounts of such materials might be present in some paper machine systems due to making various grades of product, or might be introduced into a papermaking system through recycling processes. Likewise, substantially no wax was used in the coatings.

TABLE 1

| Coating Formulations | | | | | | | | | |
|---|---|---|---|---|---|---|---|---|---|
| | BC | TC1 | TC2 | TC3 | TC4 | TC5 | TC6 | TC7 | TC8 |
| Clay-A | 100 | | | | | | | | |
| Clay-B | | 78 | 84 | 89 | 95 | 100 | 84 | 84 | 84 |
| $TiO_2$ | | 22 | 16 | 11 | 5 | 0 | 16 | 16 | 16 |
| SBR Latex | 21 | 32 | 32 | 32 | 32 | 32 | 28 | 37 | 40 |
| Protein | 2.5 | 3 | 3 | 3 | 3 | 3 | 3 | 3 | 3 |
| Total Binder (parts per 100 parts of pigment) | 23.5 | 35 | 35 | 35 | 35 | 35 | 31 | 40 | 43 |

As shown in Table 1, the total binder to pigment ratio (parts of binder, by weight, to 100 parts of pigment) of the base coat (BC) formulation was 23.5, and for the top coat (TCx) formulations ranged from 31 to 43. This is more than the binder to pigment ratio for typical printability coatings (where rapid absorption of ink is desired) and less than the binder to pigment ratio of typical barrier coatings. Thus it appears that an effective binder to pigment ratio may be from about 25 to about 45 parts binder per 100 parts pigment (by weight), or from 30 to 40 parts binder per 100 parts pigment. However, perhaps acceptable results (good 3M kit test, no blocking, and good repulpability) might be achieved with a slightly greater range.

Paperboard samples were made using unbleached sulfate (kraft) substrate with a caliper of 18 pt (0.018") or 14 pt (0.014"). The samples were coated on one side (herein termed the "coated side") using a pilot blade coater to apply a base coat and then a top coat, or using an on-machine blade coater to apply a base coat and then a pilot blade coater for a top coat. The pilot results are expected to be representative of results that might be achieved on a production paper machine or a production off-machine coater. The resulting coated paperboard is typically known as coated natural kraft (CNK).

Test results are shown in Tables 2 and 3. The oil and grease resistance (OGR) of the samples was measured on the 'coated side' by the 3M kit test (TAPPI Standard T559 cm-02). With this test, ratings are from 1 (the least resistance to oil and grease) to 12 (excellent resistance to oil and grease penetration).

Table 2 shows results for 18 pt samples, where the aqueous barrier coated samples using 8 variations of top coat gave 3M kit levels between 5 to 7, compared with a print grade control having a 3M kit rating less than 1. Moisture resistance of the coatings was evaluated by WVTR (water vapor transmission rate) at 38° C. and 90% relative humidity; TAPPI Standard T464 OM-12) and water Cobb (TAPPI Standard T441 om-04). WVTR was markedly decreased for the barrier coated samples, as was the water Cobb rating. WVTR was further decreased with increase of binder level from 31 parts (TC6) to 35 parts (TC2), 40 parts (TC7), 43 (TC8). (GE) Brightness was measured on a Technidyne Brightimeter Micro S-5 according to TAPPI standard T452. Brightness was lower with the barrier coatings than with the print grade control; however, brightness of the barrier coatings was increased with increase of $TiO_2$ amount in the coatings (e.g., $TiO_2$ level in the order of TC1>TC2>TC3>TC4>TC5). At the same $TiO_2$ level, relatively lower binder level resulted in relatively higher brightness (e.g., binder level in the order of TC6<TC2<TC7<TC8).

TABLE 2

Results for 18 pt Paperboard

| | Print Grade Control | BC/TC1 | BC/TC2 | BC/TC3 | BC/TC4 | BC/TC5 | BC/TC6 | BC/TC7 | BC/TC8 |
|---|---|---|---|---|---|---|---|---|---|
| BC Coat wt lb/3000 $ft^2$ | 10.5 | 10.1 | 10.1 | 10.1 | 10.1 | 10.1 | 10.1 | 10.1 | 10.1 |
| TC Coat wt lb/3000 $ft^2$ | 9.9 | 9.0 | 9.2 | 9.4 | 8.6 | 9.3 | 8.9 | 8.6 | 9.0 |
| 3M kit | <1 | 5.2 | 6.0 | 6.0 | 6.0 | 5.2 | 5.6 | 5.6 | 6 |
| WVTR-38° C., 90% RH $g/m^2$-d | 1095 | 238 | 215 | 212 | 202 | 183 | 497 | 163 | 143 |
| Water Cobb-2 min $g/m^2$ | 68.5 | 49.2 | 47.8 | 47.1 | 51.8 | 50.0 | 60.5 | 43.6 | 42.3 |
| Brightness | 78.1 | 70.9 | 69.0 | 65.2 | 61.1 | 52.0 | 72.3 | 67.7 | 67.4 |

Figure 4:
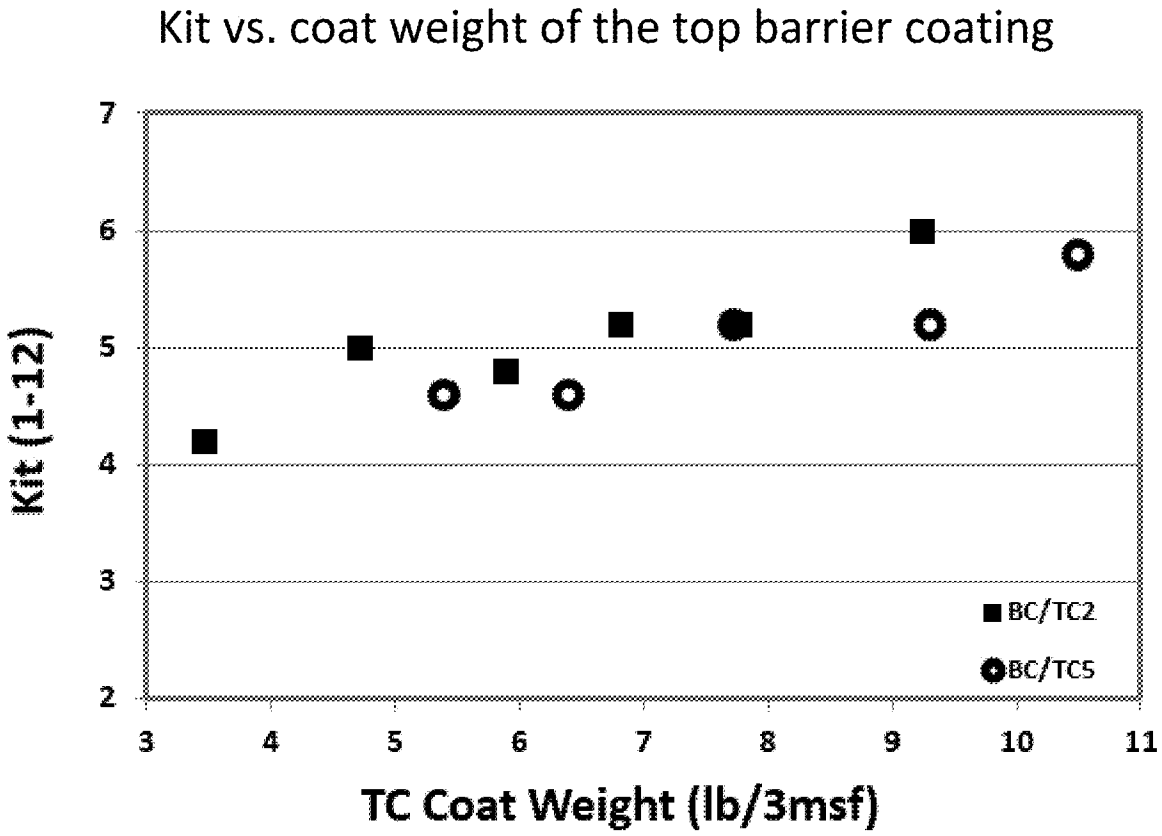
FIG. 4 is a graph of oil/grease resistance (3M kit level) vs. coat weight.

Table 3 shows results for 14 pt samples, where the aqueous barrier coated samples using 2 variations of top coat gave 3M kit levels between 5 to 7, compared with a print grade control having a 3M kit rating less than 1. As illustrated in FIG. 4, higher 3M kit values were obtained with higher coat weights of each TC2 or TC5 coating. The barrier coated results for oil Cobb (30-minute exposure) were 20 times lower than for the print grade control. Water vapor transmission rate (WVTR) was markedly decreased for the barrier coated samples, as was the water Cobb rating. The barrier coated samples did not block, and repulpability was 98.5 percent accepts or better.

TABLE 3

Results for 14 pt Paperboard

| | Print Grade Control | BC/TC2 | BC/TC5 |
|---|---|---|---|
| BC Coat wt lb/3000 $ft^2$ | 10.8 | 8.5 | 10.2 |
| TC Coat wt lb/3000 $ft^2$ | 10.5 | 10.4 | 11.8 |
| 3M kit | <1 | 7.0 | 5.4 |
| WVTR-38° C., 90% RH $g/m^2$-d | 1098 | 234 | 193 |
| Water Cobb-2 min $g/m^2$ | 50.3 | 32.8 | 28.3 |
| Oil Cobb-30 min $g/m^2$ | 9.4 | 0.56 | 0.49 |
| Repulpability % accepts | 99.5 | 99.4 | 98.5 |
| Blocking | | 0 | 0 |

Figure 5A:
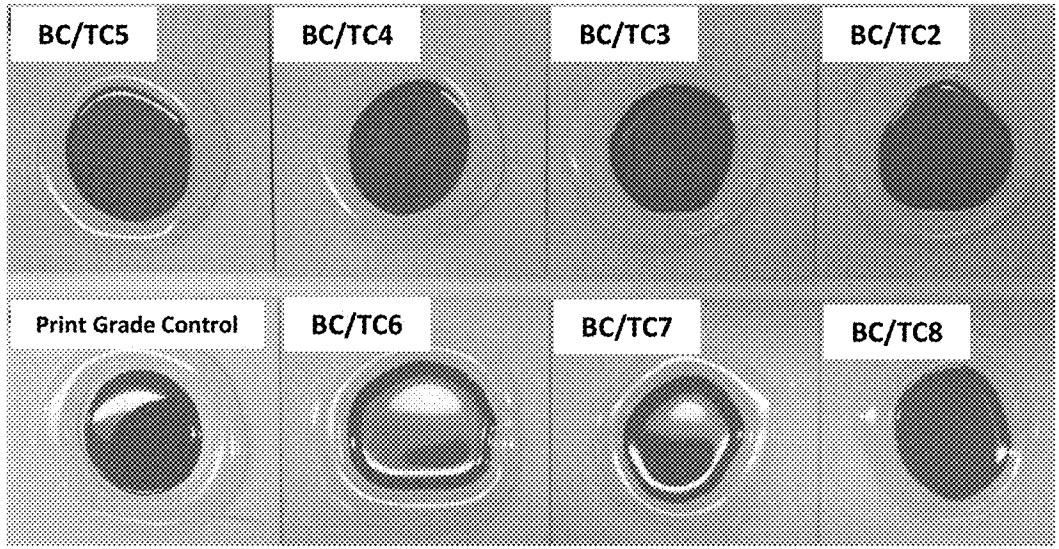
FIGS. 5A and 5B visually illustrate oil resistance for several coatings.
Figure 5B:
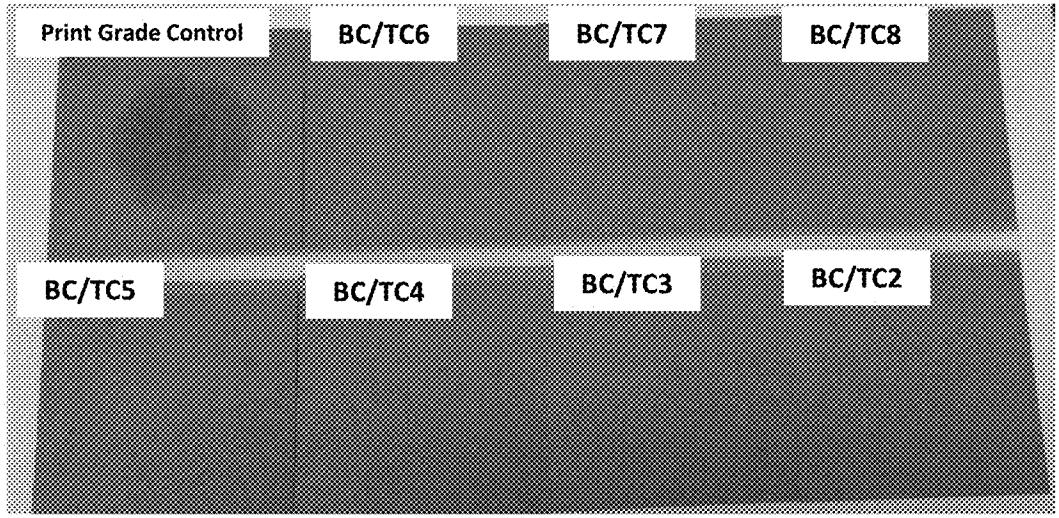

Oil absorption was also tested visually as shown in FIGS. 5A and 5B. Square samples 3 inches on a side were cut from selected 18 pt coated paperboards. As shown in FIG. 5A, a ring of hot-melt glue with an inner diameter of about 1.5 inches was applied to the coated side of each sample to retain a small pool of peanut oil. The oil was allowed to remain in contact with the barrier coating for 24 hours, and the reverse (uncoated) side of the sample was then examined. As seen in FIG. 5B, the oil had seeped through the print grade control, but not through any of the samples that had the aqueous barrier coating.

Figure 6:
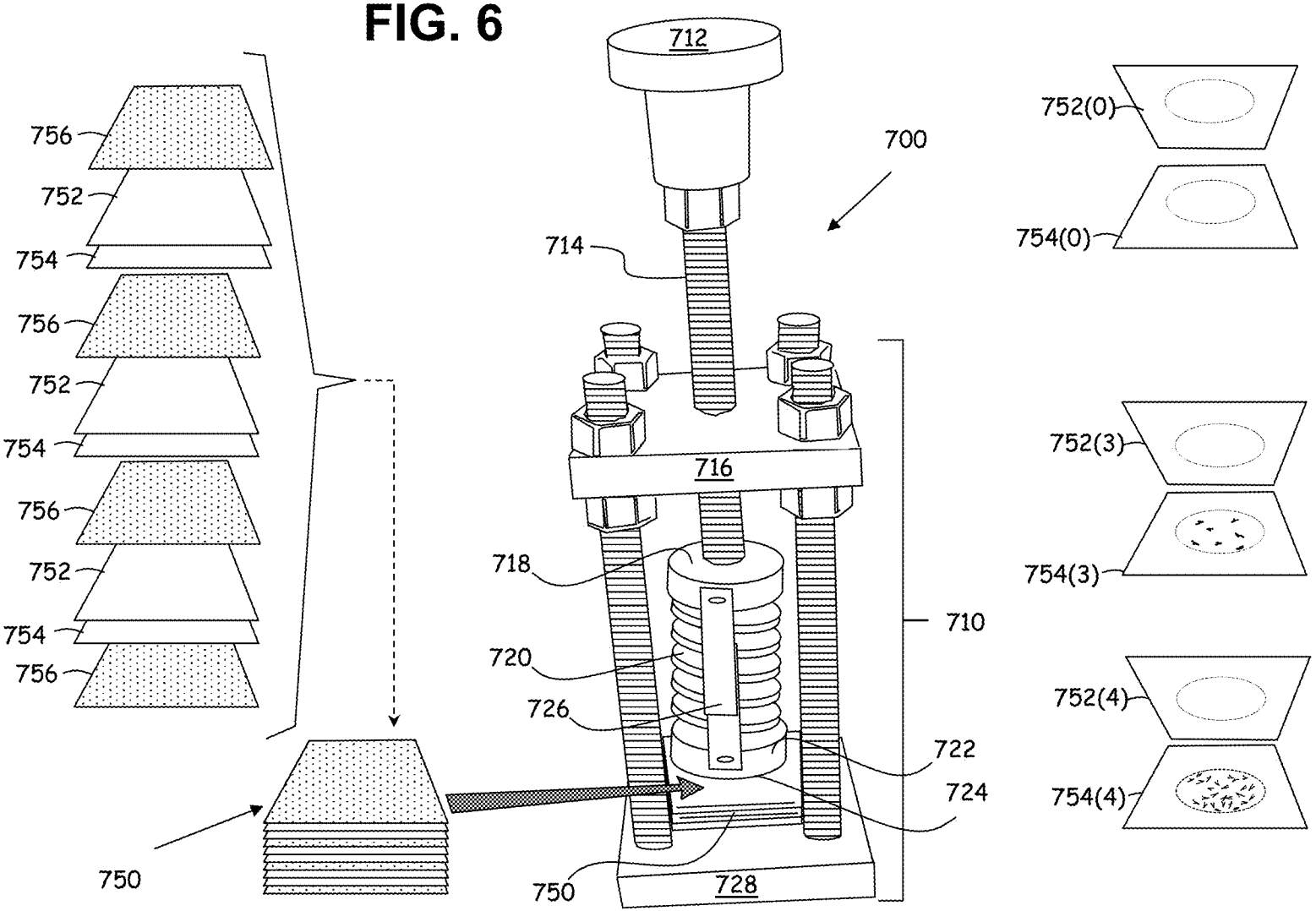
FIG. 6 shows a device and method for measuring blocking.

The blocking behaviour of the samples was tested by evaluating the adhesion between the barrier coated side and the other uncoated side. A simplified illustration of the blocking test is shown in FIG. 6. The paperboard was cut into 2"×2" square samples. Several duplicates were tested for each condition, with each duplicate evaluating the blocking between a pair of samples 752, 754. (For example, if four duplicates were test, four pairs—eight pieces—would be used.) Each pair was positioned with the 'barrier-coated' side of one piece 752 contacting the uncoated side of the other piece 754. The pairs were placed into a stack 750 with a spacer 756 between adjacent pairs, the spacer being foil, release paper, or even copy paper. The entire sample stack was placed into the test device 700 illustrated in FIG. 6.

The test device 700 includes a frame 710. An adjustment knob 712 is attached to a screw 714 which is threaded through the frame top 716. The lower end of screw 714 is attached to a plate 718 which bears upon a heavy coil spring 720. The lower end of the spring 720 bears upon a plate 722 whose lower surface 724 has an area of one square inch. A scale 726 enables the user to read the applied force (which is equal to the pressure applied to the stack of samples through the one-square-inch lower surface 724).

The stack 750 of samples is placed between lower surface 724 and the frame bottom 728. The knob 712 is tightened until the scale 726 reads the desired force of 100 lbf (100 psi applied to the samples). The entire device 700 including samples is then placed in an oven at 50° C. for 24 hours. The device 700 is then removed from the test environment and cooled to room temperature. The pressure is then released and the samples removed from the device.

The samples were evaluated for tackiness and blocking by separating each pair of paperboard sheets. The results were reported as shown in Table 4, with a "0" rating indicating no tendency to blocking.

TABLE 4

| Blocking Ratings |
|---|
| 0 = samples fall apart without any force applied |
| 1 = samples have a light tackiness but separate without fiber tear |
| 2 = samples have a high tackiness but separate without fiber tear |
| 3 = samples are sticky and up to 25% fiber tear or coat damage (area basis) |
| 4 = samples have more than 25% fiber tear or coat damage (area basis) |

Blocking damage is visible as fiber tear, which if present usually occurs with fibers pulling up from the non-barrier surface of samples 754. If the non-barrier surface was coated with a print coating, then blocking might also be evinced by damage to the print coating.

For example, in as symbolically depicted in FIG. 6, samples 752(0)/754(0) might be representative of a "0" blocking (no blocking). The circular shape in the samples indicates an approximate area that was under pressure, for instance about one square inch of the overall sample. Samples 752(3)/754(3) might be representative of a "3" blocking rating, with up to 25% fiber tear in the area that was under pressure, particularly in the uncoated surface of sample 754(3). Samples 752(4)/754(4) might be representative of a "4" blocking rating with more than 25% fiber tear, particularly in the uncoated surface of sample 754(4). The depictions in FIG. 6 are only meant to approximately suggest the percent damage to such test samples, rather than showing a realistic appearance of the samples.

Repulpability was tested using an AMC Maelstom repulper. 110 grams of coated paperboard, cut into 1"×1" squares, was added to the repulper containing 2895 grams of water (pH of 6.5±0.5, 50° C.), soaked for 15 minutes, and then repulped for 30 minutes. 300 mL of the repulped slurry was then screened through a vibrating flat screen (0.006" slot size). Rejects (caught by the screen) and fiber accepts were collected, dried and weighed. The percentage of accepts was calculated based on the weights of accepts and rejects, with 100% being complete repulpability.

In summary, the results show that paperboard with good oil, grease and moisture resistance is achieved by double coating with conventional coating materials. The tests described above used a blade coater to apply coating. As previously discussed, various types of coating devices may be used.

Once given the above disclosure, many other features, modifications or improvements will become apparent to the skilled artisan. Such features, modifications or improvements are, therefore, considered to be a part of this invention, the scope of which is to be determined by the following claims.

While preferred embodiments of the invention have been described and illustrated, it should be apparent that many modifications to the embodiments and implementations of the invention can be made without departing from the spirit or scope of the invention. It is to be understood therefore that the invention is not limited to the particular embodiments disclosed (or apparent from the disclosure) herein, but only limited by the claims appended hereto.

The invention claimed is:

1. A coated paperboard comprising:

a paperboard substrate having a first side and a second side;

a first coating in contact with the first side, the first coating having a coat weight from 5 to 12 lbs per 3000 $ft^2$ and comprising binder and pigment, and substantially no fluorochemical or wax;

a second coating applied over the first coating, the second coating having a coat weight from 5 to 12 lbs per 3000 $ft^2$ and comprising binder and pigment, and substantially no fluorochemical or wax;

wherein the binder to pigment ratio in the first coating is less than the binder to pigment ratio in the second coating;

wherein the coated paperboard provides barrier properties to at least one of oil, grease, and moisture; and wherein the coated paperboard is repulpable to the extent that after repulping the percentage accepts is at least 98%.

2. The coated paperboard of claim 1, wherein the binder to pigment ratio in the first coating is between 15 to 30 parts binder per 100 parts pigment, by weight.

3. The coated paperboard of claim 2, wherein the binder to pigment ratio in the first coating is between 20 to 25 parts binder per 100 parts pigment, by weight.

4. The coated paperboard of claim 1, wherein the binder to pigment ratio in the second coating is between 20 to 40 parts binder per 100 parts pigment, by weight.

5. The coated paperboard of claim 4, wherein the binder to pigment ratio in the second coating is between 25 to 35 parts binder per 100 parts pigment, by weight.

6. The coated paperboard of claim 1, wherein the 3M kit test value is at least 5.

7. The coated paperboard of claim 1, wherein the coated paperboard has a 30-minute oil Cobb test of at most 2 grams per square meter.

8. The coated paperboard of claim 7, wherein the coated paperboard has a 30-minute oil Cobb test of at most 1 gram per square meter.

9. The coated paperboard of claim 1, wherein the coated paperboard has a water vapor transmission rate of less than 500 grams per square meter per day.

10. The coated paperboard of claim 9, wherein the coated paperboard has a water vapor transmission rate of less than 300 grams per square meter per day.

11. The coated paperboard of claim 10, wherein the coated paperboard has a water vapor transmission rate of less than 200 grams per square meter per day.

12. The coated paperboard of claim 1, wherein the coated paperboard is repulpable to the extent that after repulping the percentage accepts is at least 99%.

13. The coated paperboard of claim 1, having no tendency toward blocking after being held for 24 hours at 50° C. at a pressure of 100 psi.

14. The coated paperboard of claim 1, wherein the binder of either the first coating or the second coating comprises at least one of polyvinyl acetate, styrene acrylate copolymer, styrene butadiene copolymer, and protein.

15. The coated paperboard of claim 1, wherein the pigment of either the first coating or the second coating comprises at least one of clay, calcium carbonate, and titanium oxide.

* * * * *